US010587963B2

(12) United States Patent
Patel

(10) Patent No.: US 10,587,963 B2
(45) Date of Patent: Mar. 10, 2020

(54) APPARATUS AND METHOD TO COMPENSATE FOR ASYMMETRICAL HEARING LOSS

(71) Applicant: Malini B Patel, Orland Park, IL (US)

(72) Inventor: Malini B Patel, Orland Park, IL (US)

( * ) Notice: Subject to any disclaimer, the term of this patent is extended or adjusted under 35 U.S.C. 154(b) by 0 days.

(21) Appl. No.: 16/522,701

(22) Filed: Jul. 26, 2019

(65) Prior Publication Data

US 2020/0037085 A1 Jan. 30, 2020

Related U.S. Application Data

(63) Continuation-in-part of application No. 16/047,063, filed on Jul. 27, 2018.

(51) Int. Cl.
*H04R 25/00* (2006.01)

(52) U.S. Cl.
CPC ..... *H04R 25/505* (2013.01)

(58) Field of Classification Search
CPC ..... H04R 25/552
See application file for complete search history.

(56) References Cited

U.S. PATENT DOCUMENTS 5,434,924 A * 7/1995 Jampolsky ..... H04R 25/502 381/17
2002/0041695 A1* 4/2002 Luo ..... H04R 3/005 381/313
2010/0020995 A1* 1/2010 Elmedyb ..... H04R 25/453 381/318
2010/0111338 A1* 5/2010 Ypma ..... H04R 25/552 381/314
2012/0148054 A1* 6/2012 Rank ..... H04R 25/552 381/23.1
2013/0170653 A1* 7/2013 Gran ..... H04R 25/552 381/23.1
2013/0223661 A1* 8/2013 Uzuanis ..... H04R 1/1041 381/314
2014/0169601 A1* 6/2014 Pedersen ..... H04R 25/48 381/316
2015/0110313 A1* 4/2015 Feilner ..... H04R 25/50 381/312
2016/0112811 A1* 4/2016 Jensen ..... H04R 25/552 381/17

* cited by examiner

*Primary Examiner* — Matthew A Eason
(74) *Attorney, Agent, or Firm* — Kelly & Krause, Ltd.

(57) ABSTRACT

Sound captured by a first microphone proximate to a severely-impaired first ear is processed to compensate for the hearing loss of the other, less-impaired second ear and then provided to the second ear through a sound transducer or speaker located inside or adjacent the second ear. The same sounds picked up by the first microphone are processed differently for the first and more severely impaired first ear and then provided to the first, severely-impaired ear through its own transducer. Sounds captured by a second microphone proximate to a less-impaired second ear are processed according to the second ear impairment and provided into the second ear by the second and different transducer for the second ear.

9 Claims, 2 Drawing Sheets

APPARATUS AND METHOD TO COMPENSATE FOR ASYMMETRICAL HEARING LOSS

RELATED APPLICATIONS

This application is a continuation-in-part of U.S. application Ser. No. 16/047,063 filed Jul. 27, 2018, entitled "Apparatus and Method for to Compensate for Asymmetrical Hearing Loss." This application claims the benefit of the filing date of that prior application.

BACKGROUND

As used herein, "asymmetric hearing loss" refers to the hearing loss or impairment of one ear that is greater than a hearing loss or impairment of the other ear. Prior art methods that compensate for asymmetric hearing loss require either surgery, profound degree of sensorineural hearing loss, or choosing between either a device for localization or a device for better speech clarity and intelligibility.

Prior art methods fail to provide a non-surgical option which enables both localization ability and clarity of speech. Individuals with asymmetric hearing loss and who have medical contraindications to surgery, or would prefer to have the ability to localize to the source of a sound AND improve intelligibility/clarity, currently have no treatment options. A non-surgical apparatus designed to help people with a large range of asymmetric hearing loss (normal to severe degree) would be an improvement over the prior art.

DETAILED DESCRIPTION

For the sake of convenience, an ear having the greatest or severest hearing impairment of two ears is referred to herein as the "first" ear. The other ear, having a lesser or no hearing loss, is referred to as the second ear.

The first ear with a severe impairment could be either the left or right-side ear. Similarly, the second ear with either no impairment or an impairment less severe than the first ear could be the right or left-side ear.

With regard to the word "severe" audiologists define degrees of hearing loss as normal, mild, moderate, severe, and profound. As used herein, the word "severe" should be construed to mean that the hearing loss in one ear is greater than the hearing loss of the other ear.

A used herein, "transducer" refers to a device that converts electrical signals to mechanical energy, examples of which include a speaker that generates acoustic energy by the vibration of a speaker cone and a motor, which generates vibratory signals or vibration responsive to electrical signals provided to the motor. A transducer is considered to be "acoustically coupled" to an ear by either placement of the transducer inside the ear canal or, placement of the transducer adjacent to the ear canal and then routed into canal by an earpiece such that acoustic signals can be detected audibly by the inner ear.

Figure 1:
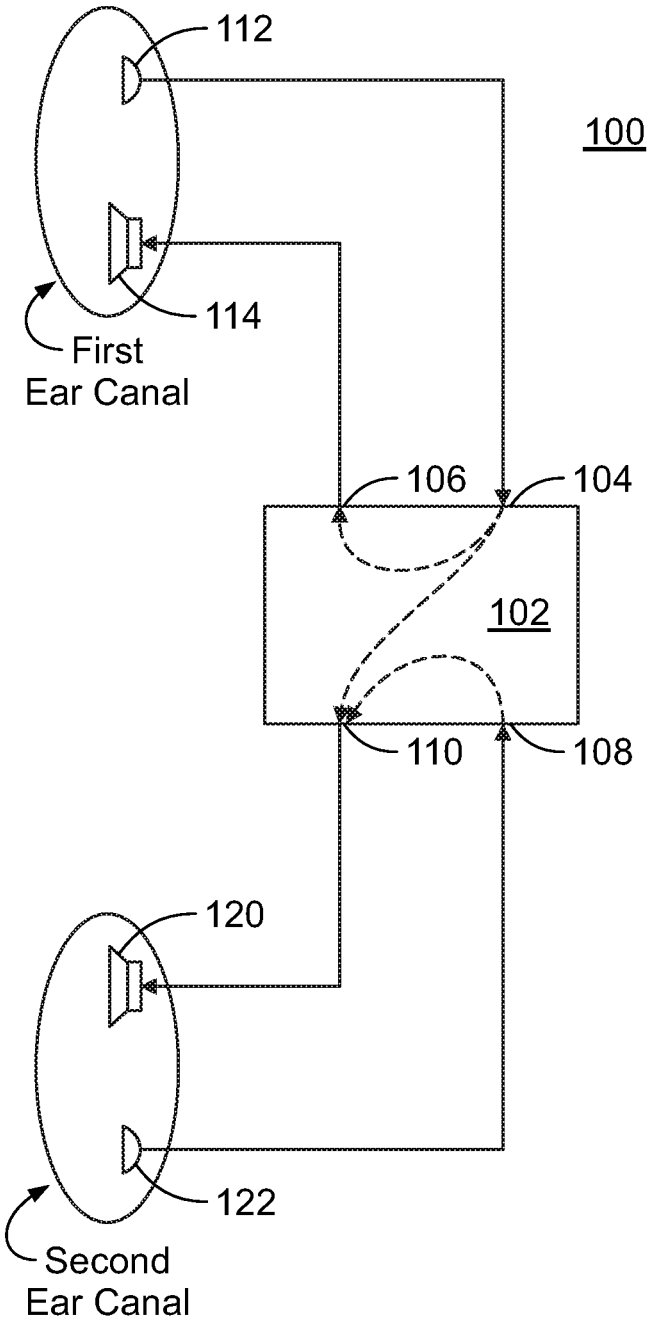
FIG. 1 is a block diagram of an apparatus to compensate for asymmetrical hearing loss.

FIG. 1 is a block diagram of an apparatus 100 to compensate for asymmetrical hearing loss. The preferred embodiment of the apparatus 100 comprises a processor 102 coupled by either wire or wirelessly to two microphones 112, 122 and two transducers 114, 120 embodied as small speakers that fit into an ear canal.

As shown in the figure, the processor 102 has at least two inputs and two outputs. A "first" processor input 104 is coupled to the first ear microphone 112. A "first" output 106 is coupled to the first ear transducer 114. A "second" input 108 is coupled to the second ear microphone 122. A "second" output 110 is coupled to the second ear transducer 120.

The microphones 112 and 122 are preferably "proximate" to an ear, which means the microphones are behind or on top of the pinna or inside the ear canal or concha area. Regardless, the microphones 112 and 122 capture sound at the first and second sides of the wearer's head and convert those detected sounds into electrical signals, which the microphones provide to the processor 102.

A digital signal processor or DSP is a well-known special-purpose digital device, that can manipulate mathematical representations of audio signals (sound) and thereby improve or change an audio signal's quality or characteristics. "Microprocessors" and "microcontrollers" are considered herein as a "general purpose" processors that can also manipulate mathematical representations of sound but microprocessors and microcontrollers are considered herein as being less efficient than a DSP when manipulating mathematical representations of sound. Whether a "processor" is considered to be a digital signal processor or a general purpose processor, it is well known that present-day semiconductor fabrication techniques permit more than one of them to be fabricated into a single semiconductor die. It is therefore possible to have more than one processor located on the same physical semiconductor device substrate In FIG. 1, the "processor" identified by reference numeral 102 is can be embodied as a single digital signal processor, which receives audio signals from two microphones and outputs audio signals to two different speakers but the processor is preferably embodied as two separate digital signal processors or DSPs, preferably on the same semiconductor die. In a first alternate embodiment, the processor 102 is embodied as a single, conventional microprocessor or microcontroller. In a second alternate embodiment, the processor 102 is embodied as two separate conventional microprocessors or microcontrollers.

However the processor 102 depicted in FIG. 1 is embodied, the processor 102 t receives electrical signals generated by a first microphone for a first ear, likely having a sensorineural hearing loss and provides a "modified" version of the signals detected by the first microphone into the transducer for the second ear. In the preferred embodiment, audio signals detected by the microphone in the first ear are thus modified to compensate for hearing impairment characteristics of the second ear. The sound entering microphone 112 is processed, i.e., modified to compensate for characteristics of the hearing loss of the second "better" ear.

In addition to providing processed sound to the second or "better" ear that was detected by the microphone 112 in the impaired first ear, the processor 102 provides a second and differently modified version of the sound from the first ear microphone 112 to the transducer 114 inside the first ear.

Sound modification provided by the processor 102 includes but is not limited to, linearly amplifying all detected sounds by the same level or amount. Sound modification also includes selectively amplifying different frequency ranges. By way of example, selectively amplifying sound includes amplification of audio signals between say, 200 Hz. and 800 Hz. by a first level or amount, amplifying signals above 800 Hz. but less than 2000 Hz. by a second level or amount and, amplifying signals above 2000 Hz. by a third level or amount. Unlike some prior art hearing aids, the sound modification provided by the processor 102 excludes estimates of a "target signal," excludes estimates of a noise signal and excludes phase shifting signals that represent a microphone audio signal. The sound modification provided by the processor 102 is thus much simpler than that provided by some prior art hearing aids and is therefore much less expensive to implement.

The transducer 114 inside the first impaired ear could be analog, digital, or piezoelectric. The processor 102 thus generates a signal into the severely impaired first ear that can be heard audibly by the user.

Still referring to the processor 102, in addition to receiving, modifying, and returning sound to the first ear and sending modified sound to the second ear from the first ear, the processor 102 also receives signals from second ear microphone 122 and provides a modified version of those signals to a transducer 120 inside the user's relatively good, second ear. The processor 102 thus provides processed sound to the second ear in order to compensate for possible hearing loss, if necessary, it also receives signals from the microphone 122 in the better or normal second ear and provides a modified version of those signals to the transducer 120 inside the user's relatively good second ear. In a preferred embodiment, and depending on the degree of hearing loss, the microphones 112 and 122 are located at the top or behind the pinnas or possibly inside the ear canal, concha, or helix area.

Figure 2:
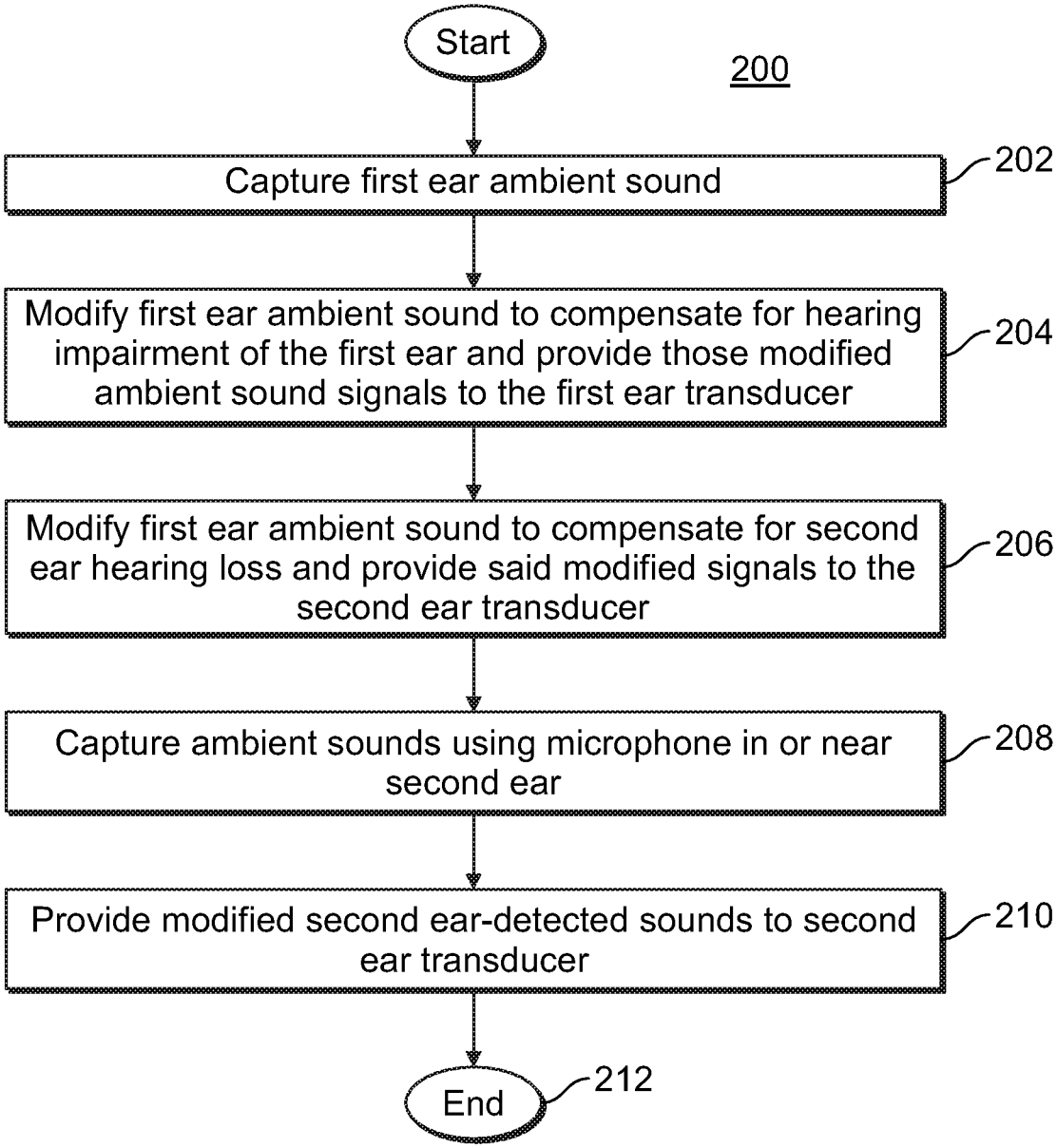
FIG. 2 depicts steps of a method to compensate for asymmetrical hearing loss.

FIG. 2 depicts a method 200 to compensate for asymmetrical hearing loss. The method steps shown in FIG. 2 are preferably performed by the processor 102 shown in FIG. 1 when the processor executes program instructions. Those of ordinary skill in the art will recognize that processor instructions can be stored in non-transitory semiconductor memory that is co-located on the same semiconductor die as the processor 102.

In a first step 202, sound is captured by a microphone located in or around the "first" impaired ear. As is well known, the microphone generates an electrical signal, which represents the acoustic energy that impinges on the microphone.

At a second step 204, the sound captured by the first ear microphone, represented by electrical signals from the microphone, is modified by a processor to compensate for the first ear hearing impairment. The processor sends the modified sound, represented by electrical signals that are modifications of those received from the first ear microphone, to the transducer of the first ear. Typically, the electrical signal from the microphone that represents sound would be processed from air conduction signals, but possibly bone-conduction. Ultimately, the transducer of the "first" or "poorer" ear and the processor it is coupled to sends an amplified audible sound into the first "poorer" ear.

In a third step 206, first ear sound is modified differently by a processor to compensate for hearing loss of the second and less severely impaired ear. In some instances, a person's "second" ear might not require any compensation, in which case, second ear sound modification in order to compensate for second ear hearing loss could be omitted; a microphone for the second ear is not required. In most instances, however, the signals provided to the second ear transducer are amplified differently according to frequency to compensate for a hearing loss characteristic of the second ear.

At a subsequent step 208, ambient sounds are captured by a microphone in or near the second ear. The sound captured by the microphone in or proximate to the second ear is modified at step 210 and provided into the second ear to compensate for any hearing impairment of the second ear. The method shown in FIG. 2 thus provides a method to compensate for an asymmetric hearing loss by detecting sounds entering an ear that has little or no functionality and providing a first modified version of that sound to a better ear and a second and differently-modified version of that sound into that same ear, which could be either a greatly amplified copy of the sound or a vibratory signal either of which would at least "notify" a person that sound is entering the ear with little or no hearing functionality. A second and differently compensated version of the same sound is provided to the person's better or perhaps normally-functioning ear.

Providing amplified-appropriate sound to necessary frequencies, via air or bone conduction, to both the poor ear and the good ear provides an ability to localize or identify the direction of a sound source, which is important for basic communication and safety, an example of which is an ambulance siren passing on one side or the other. In addition to providing amplified sound into the poor ear and into the good ear if necessary, the disclosed method and apparatus provide differently-modified versions of sound obtained from the poor ear into the user's better ear. By providing differently-modified versions of the same sound from the poor ear side to the better ear side, a user can be provided with better clarity/intelligibility of speech and ultimately improved communication ability. The apparatus and method thus improves two important communication and safety functions, namely, localization ability and clarity of speech.

The foregoing description is for illustration purposes. The true scope of the invention is set forth in the claims.

What is claimed is:

1. An apparatus to compensate for asymmetric hearing loss using a processor, the apparatus comprising:

a processor;

a first microphone connected to the processor and being proximate to a first ear, the first ear having a hearing impairment;

a first sound transducer connected to the processor and being acoustically coupled to first ear;

a second sound transducer connected to the processor and being acoustically coupled to the second ear, which may or may not have a hearing impairment; wherein:

the processor is configured to:

receive a first signal from the first microphone and provide a first modified version of said first signal to the second sound transducer, the first modified version of the first signal being different amplifications of different ranges of frequencies of sounds in the first signal, the first modified version of the first signal excluding an estimate of a target signal and excluding an estimate of a noise signal and excluding a phase shifted signal representing a microphone audio signal; and, provide a second modified version of the first signal to the first sound transducer.

2. The apparatus of claim 1, further comprising:

a second microphone coupled to the processor, the second microphone being proximate to the second ear, said second ear having a second and different hearing impairment that is less severe than the first hearing impairment of the first ear;

and wherein the processor:

receives a first signal from the first microphone and provides a first modified version of said first signal to the second sound transducer, the first modified version of the first signal being selective amplifications of different ranges of frequencies of sounds in the first signal and excluding an estimate of a target signal and excluding an estimate of a noise signal and excluding a phase shifted signal representing a microphone audio signal; and, provides a second modified version of the first signal to the first transducer, the second modified version of the first signal being selective amplifications of the different ranges of frequencies of sounds in the first signal and excluding an estimate of a target signal and excluding an estimate of a noise signal, and excluding a phase shifted signal representing a microphone audio signal; and wherein the processor:

receives a second signal from the second microphone and provides a modified version of said second signal to the second transducer, the modified version of the second signal being only selective amplifications of different ranges of frequencies of sounds in the second signal and excluding an estimate of a target signal and excluding an estimate of a noise signal and excluding a phase shifted signal representing a microphone audio signal.

3. The apparatus of claim 1, wherein:

the signal processor is configured to provide the first modified version of said first signal such that it is both frequency modified and amplitude modified to compensate for the first hearing impairment of the second ear; and wherein the first modified version of said first signal provided to the first transducer in the first ear is a substantially linearly amplified version of the first signal.

4. The apparatus of claim 1, wherein:

the signal processor is configured to provide the first modified version of said first signal such that it is frequency modified and amplitude modified to compensate for the second hearing impairment of the second ear; and wherein the first modified version of said first signal to the first transducer comprises frequency-specific amplification of the first signal.

5. The apparatus of claim 2, wherein the first microphone and first sound transducer are located proximate to the first ear.

6. A method to compensate for asymmetrical hearing loss using a processor, which is operatively coupled to a separate sound transducer for each of two ears, the method comprising:

capturing ambient sounds using a first microphone that is coupled to the processor, the first microphone being proximate to a first ear, having a first hearing impairment;

providing from the processor, a first modification of the ambient sounds captured by the first microphone into the first ear using a first sound transducer that is acoustically coupled into the first ear and providing a second modification of the ambient sounds captured by the first microphone into the second ear using a second sound transducer that is acoustically coupled into the second ear, the first modification of the ambient sounds being amplifications of different ranges of frequencies of sounds in the first signal and excluding an estimate of a target signal and excluding an estimate of a noise signal, the second modification of the ambient sounds being different amplifications of different ranges of frequencies of sounds in the first signal and excluding an estimate of a target signal and excluding an estimate of a noise signal and excluding a phase shifted signal representing a microphone audio signal;

capturing ambient sounds using a second microphone that is coupled to the processor, the second microphone being proximate to the second ear, the second ear having a second and different hearing impairment less severe than the first hearing impairment; and providing from the processor, modifications of the ambient sounds captured by the second microphone into the second ear using the second sound transducer, the modifications of the ambient sounds captured by the second microphone being different amplifications of different ranges of frequencies of sounds in the ambient sounds captured by the second microphone and excluding an estimate of a target signal and excluding an estimate of a noise signal and excluding a phase shifted signal representing a microphone audio signal.

7. The method of claim 6, wherein the second ear hearing impairment is less severe than the first ear hearing impairment.

8. The apparatus of claim 1, wherein the second modified version of the first signal that is provided to the first transducer, is selective amplifications of different ranges of frequencies of sounds in the first signal and does not include an estimate of a target signal nor does it include an estimate of a noise signal.

9. The apparatus of claim 2, wherein the first microphone, second microphone, first sound transducer and second sound transducer are connected to the same processor.

* * * * *